US011421912B2

(12) United States Patent
Maruyama et al.

(10) Patent No.: US 11,421,912 B2
(45) Date of Patent: Aug. 23, 2022

(54) PACKING SYSTEM INCLUDING PACKING MATERIAL FOR AIR CONDITIONER AND AIR CONDITIONER

(71) Applicant: Mitsubishi Electric Corporation, Tokyo (JP)

(72) Inventors: Masaaki Maruyama, Tokyo (JP); Takaaki Takishita, Tokyo (JP); Tatsuo Furuta, Tokyo (JP); Hiroyuki Hatakeyama, Tokyo (JP); Naoya Matsunaga, Tokyo (JP); Takahiro Komatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 243 days.

(21) Appl. No.: 16/731,319

(22) Filed: Dec. 31, 2019

(65) Prior Publication Data

US 2020/0158374 A1 May 21, 2020

Related U.S. Application Data

(62) Division of application No. 14/613,499, filed on Feb. 4, 2015, now abandoned.

(30) Foreign Application Priority Data

Mar. 31, 2014 (JP) ..... JP2014-072203

(51) Int. Cl.
*F24F 13/32* (2006.01)
*F24F 13/20* (2006.01)
(Continued)

(52) U.S. Cl.
CPC ..... *F24F 13/32* (2013.01); *B65D 81/36* (2013.01); *F24F 1/0047* (2019.02); *F24F 13/20* (2013.01);
(Continued)

(58) Field of Classification Search
CPC ..... F24F 13/20; F24F 13/32; F24F 2221/32; F24F 2001/0037; B65D 81/36;
(Continued)

(56) References Cited

U.S. PATENT DOCUMENTS 2,072,193 A 3/1937 Wierzbicki
2,100,604 A * 11/1937 Kollsman ..... B64D 45/00 248/27.1
(Continued)

FOREIGN PATENT DOCUMENTS

JP H07-330035 A 12/1995
JP 3143311 B2 3/2001
(Continued)

OTHER PUBLICATIONS

Extended European Search Report dated Aug. 26, 2015 issued in corresponding EP patent application No. 15159144.3.
(Continued)

*Primary Examiner* — Anthony D Stashick
*Assistant Examiner* — James M Van Buskirk
(74) *Attorney, Agent, or Firm* — Posz Law Group, PLC

(57) ABSTRACT

Provided is a packing material which packs at least a unit main body of an air conditioner to be installed in a ceiling, the packing material including: a cover part for covering an opening part through which components inside the unit main body are exposed; and a cut and bent up part which has a slit part for inserting a protruding portion of the unit main body and fixes the cover part on the unit main body. The packing material can eliminate the need for a curing sheet and a tape for fixing the curing sheet while keeping out dust etc.

9 Claims, 4 Drawing Sheets

(51) Int. Cl.
*B65D 81/36* (2006.01)
*F24F 1/0047* (2019.01)

(52) U.S. Cl.
CPC .. *B65D 2585/6812* (2013.01); *F24F 2221/32* (2013.01)

(58) Field of Classification Search
CPC ..... B65D 2585/6812; B65D 71/0092; B65D 71/0096; B65D 19/00; B65D 25/107; B65D 25/10; B65D 81/133; B65D 81/022; B65D 81/107; B65D 81/113; B65D 85/03; B65D 51/24; B65D 47/2031; H02G 3/081; H02G 3/086; H02G 3/088
USPC ..... 220/229, 253, 324, 315, 212; 206/320, 206/784, 521.15, 521.4, 477
See application file for complete search history.

(56) References Cited

U.S. PATENT DOCUMENTS

| | | | |
|---|---|---|---|
| 5,318,180 | A | 6/1994 | Grigsby |
| 5,595,339 | A | 1/1997 | Correll |
| 5,655,382 | A | 8/1997 | Chen |
| 7,882,956 | B2 | 2/2011 | McDonald et al. |
| 8,857,701 | B2 | 10/2014 | Mandreucci et al. |
| 2010/0201232 | A1 | 8/2010 | Gajina |
| 2010/0301105 | A1 | 12/2010 | McClung, III |
| 2011/0250833 | A1 | 10/2011 | Breed |
| 2014/0056555 | A1 | 2/2014 | Chang et al. |

FOREIGN PATENT DOCUMENTS

| | | | |
|---|---|---|---|
| JP | 2003-232562 | A | 8/2003 |
| JP | 2004-161361 | A | 6/2004 |
| JP | 2010-038426 | A | 2/2010 |

OTHER PUBLICATIONS

Office Action dated Mar. 14, 2017 issued in the corresponding JP patent application No. 2014-072203 (and English translation).
Office Action dated Mar. 31, 2017 issued in corresponding CN patent application No. 201510140223.2 (and English translation).
Office Action dated Feb. 9, 2018 issued in corresponding EP patent application No. 15159144.3.
European Office Action dated Dec. 3, 2020, issued in corresponding EP Patent Application No. 15159144.3.

* cited by examiner

PACKING SYSTEM INCLUDING PACKING MATERIAL FOR AIR CONDITIONER AND AIR CONDITIONER

CROSS REFERENCE TO RELATED APPLICATIONS

The present application is a divisional application of U.S. application Ser. No. 14/613,499 filed on Feb. 4, 2015, which is based on Japanese Patent Application No. 2014-072203 filed on March 31, 2014, the contents of which are incorporated herein by reference.

TECHNICAL FIELD

The present invention relates to a packing material for packing an air conditioner.

BACKGROUND ART

Conventionally, a suspended air conditioner (e.g., a four-way cassette-type indoor unit) which is installed indoors (in an air-conditioned space) has a unit main body (casing) to be suspended on a beam etc. and a decorative panel with a dust collecting filter etc. which is mounted on the unit main body and exposed to the indoor space. Here, when an air conditioner is installed in a ceiling during construction of a building etc., there is often a time lapse between suspension of the unit main body and mounting of the decorative panel. For example, before ceiling installation, the unit main body is installed on a beam etc. and piping work and electric work are performed. Then, the ceiling is installed. After ceiling installation, the decorative panel is mounted on the unit main body (see, e.g., Patent Literature 1).

CITATION LIST

Patent Literature

Patent Literature 1: Japanese Unexamined Patent Application Publication No. 2003-232562

SUMMARY OF INVENTION

Technical Problem

It is a common practice to cover the opening part of the unit main body by fixing a curing sheet over it with a tape etc. in order to keep dust etc. out of the suspended unit main body during the period up to mounting of the decorative panel. Once the decorative panel is mounted, however, the curing sheet, the tape, etc. are to be unnecessary and cause an increase in waste.

The present invention has been devised in order to solve the above problem, and an object of the present invention is to obtain a packing material for an air conditioner which can substitute for a curing sheet etc.

Solution to Problem

A packing material for an air conditioner according to the present invention packs at least a unit main body of an air conditioner to be installed in a ceiling, the packing material including: a cover part for covering an opening part through which components inside the unit main body are exposed; and a cut and bent up part which has a slit part for inserting a protruding portion of the unit main body and fixes the cover part on the unit main body.

Advantageous Effects of Invention

According to the present invention, it is possible to utilize a packing material, which is used when transporting the air conditioner, for keeping dust etc. out of the unit main body, for example, during the period from installation of the unit main body to mounting of the decorative panel, by inserting a metal fitting of the unit to fix the packing material and covering the opening part of the unit main body. Since the need for a curing sheet and a tape for fixing the curing sheet is eliminated, waste generated during construction can be reduced.

DESCRIPTION OF EMBODIMENTS

Figure 1:
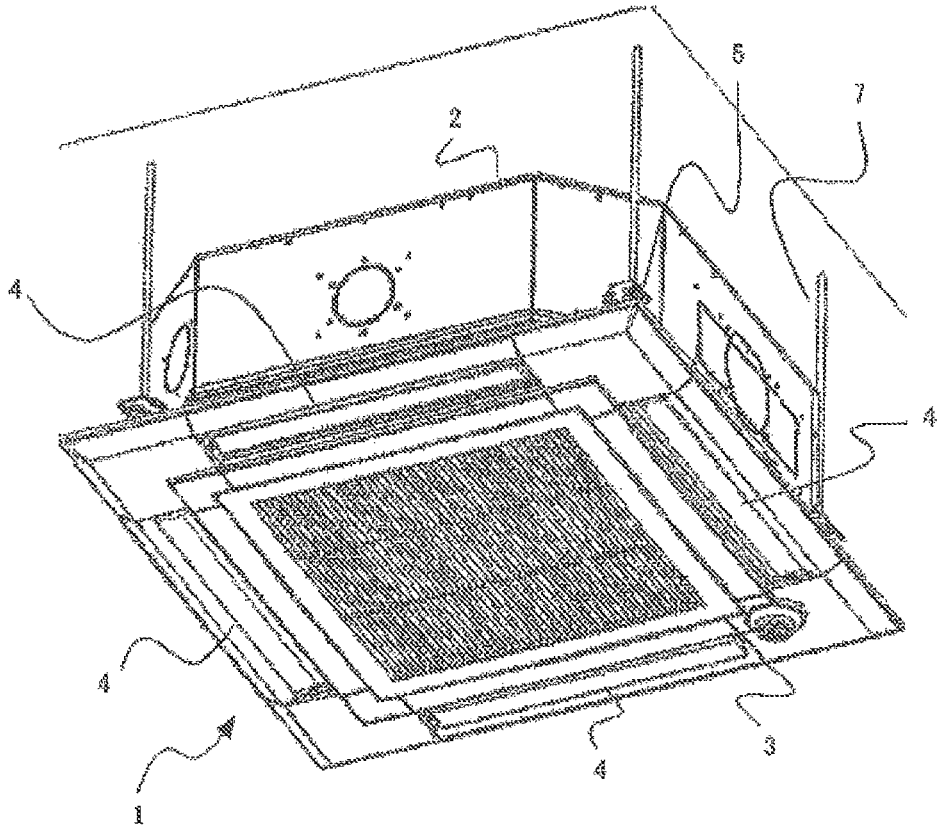
FIG. 1 is a perspective view showing the installation state of an air conditioner according to Embodiment 1 of the present invention.

In the following, an air conditioner according to embodiments of the present invention will be described with reference to the drawings. In the drawings to be described below, components denoted by the same reference signs are the same or equivalent, and the reference signs are common throughout the entire text of the embodiments to be described below. The forms of components represented in the entire text of the specification are merely examples, and are not intended to limit the present invention to those forms described herein. In particular, combinations of components are not intended to limit the present invention to those combinations described in the embodiments, but components described in one embodiment can be applied to another embodiment. The upside and the downside in the drawings shall be defined as the upper side and the lower side, respectively, for description. In some of the drawings, the dimensional relation of the components may be different from the actual dimensional relation.

Embodiment 1

FIG. 1 is a perspective view showing the installation state of an air conditioner according to Embodiment 1 of the present invention. In this embodiment, as a representative example of the air conditioner, a ceiling-embedded, four-way cassette-type indoor unit 1, which can be embedded in an indoor ceiling and has air outlets in four directions, will be described. The indoor unit 1 is connected with an outdoor unit (not shown) through a refrigerant pipe to form a refrigerant circuit through which a refrigerant is circulated for refrigeration, air conditioning, etc. Here, the air conditioner which is separated into the indoor unit 1 and the outdoor unit will be described, but the air conditioner may be an integral type. In addition, while the air conditioner will be described here, the term air conditioner in the present invention also includes ventilation devices and refrigerating devices.

As shown in FIG. 1, the indoor unit 1 of this embodiment has a box-shaped unit main body 2 having a top panel and a side panel, and an opening part directed toward an indoor space (air-conditioned space). Hanging clamps 5 are mounted at the four corners on the outside of the unit main body 2 of this embodiment. On the other hand, four hanging bolts 7 are suspended from a beam etc. and the indoor unit 1 is fixed and installed by fastening the hanging clamps 5 at arbitrary positions of the hanging bolts 7.

The unit main body 2 houses an indoor blower fan (not shown), an indoor unit heat exchanger which exchanges the heat of indoor air, etc. A decorative panel 3 having a substantially quadrangular shape in planar view, which serves as a design surface (exterior surface) of the indoor unit 1, is mounted on the lower side of the indoor unit 1 and faces the indoor space. Near the center of the decorative panel 3, a suction grille, which serves as a suction port of air into the indoor unit 1, is provided along with a dust removal filter. On each side of the decorative panel 3, an air outlet is formed along each side of the decorative panel 3. Each air outlet is provided with an airflow directing vane 4.

Figure 2A:
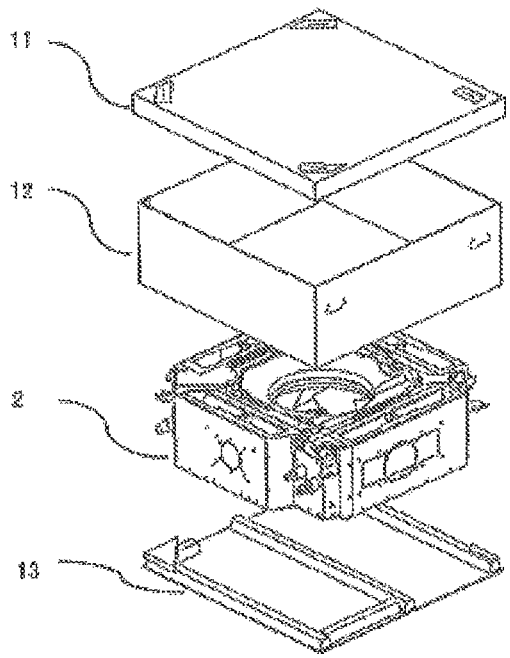
FIG. 2A is a view illustrating a packing material according to Embodiment 1 of the present invention, and showing the relation between the unit main body and the packing material.
Figure 2B:
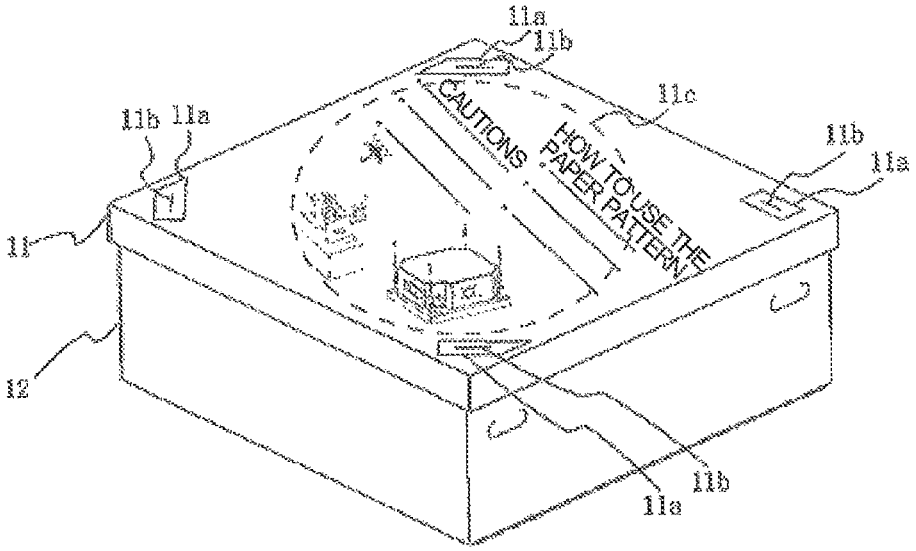
FIG. 2B is a view illustrating a packing material according to Embodiment 1 of the present invention, and showing the packing material with the unit main body packed therein.

FIGS. 2A and 2B are views illustrating the packing material according to Embodiment 1 of the present invention. The packing material packs the indoor unit 1. FIG. 2A is a view showing the relation between the unit main body 2 and the packing material. The packing material for an air conditioner has an upper cover 11, a body part cover 12, and a lower cover 13, made of cardboard. The upper cover 11 serves as a lid of the packing material and covers the upper surface of the unit main body 2. In this embodiment, the upper cover 11 is utilized as a protective sheet. In order to prevent misalignment with the body part cover 12, the upper cover 11 of this embodiment is bent at the edges (four sides) nearly at a right angle and formed into a box shape. The body part cover 12 serves as a body part of the packing material and covers the side surface of the unit main body 2. The lower cover 13 serves as a bottom part of the packing material, and covers the lower surface of the unit main body 2 and holds the unit main body 2.

FIG. 2B is a view showing the packing material with the unit main body 2 packed therein. As shown in FIG. 2B, a border is printed on the upper cover 11 which matches the outline of the lower surface part of the unit main body 2. For example, this upper cover 11 serves as a paper pattern for positioning when a hole is bored in the installed ceiling to thereby expose the unit main body 2 indoors. Other than this border, a brand name, type name, unpacking procedure, cautions, method of use, etc. are printed on the upper cover 11. Especially in this embodiment, a cutoff line etc., which serves as a cut and bent up part 11*a* and a slit part 11*b*, is printed on the upper cover 11. In view of utilizing the upper cover 11 as a protective sheet for covering the opening part of the unit main body 2, it is desirable that an ink (paint) containing a material having a static electricity removing property (an antistatic material), such as a substance containing gallium, is used for printing on the upper cover 11, although the present invention is not particularly limited to this example.

Figure 3:
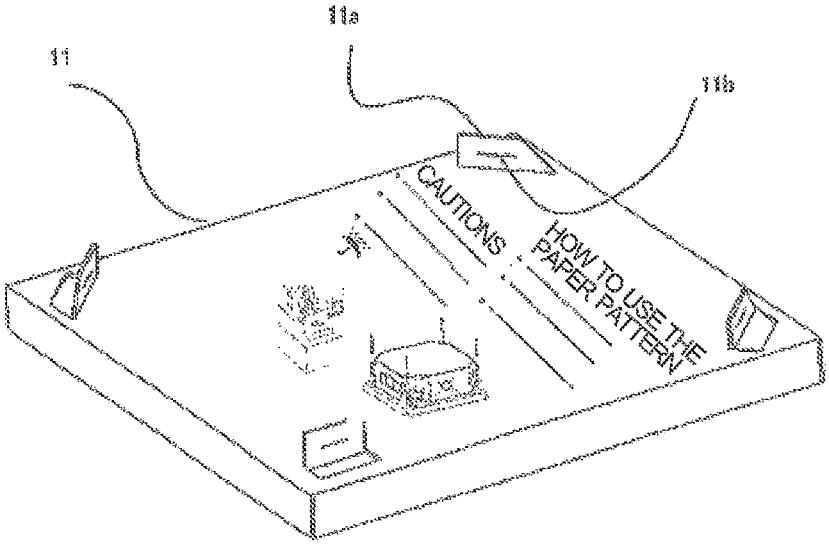
FIG. 3 is a view illustrating an upper cover 11 when used as a protective sheet according to Embodiment 1 of the present invention.

FIG. 3 is a view illustrating the upper cover 11 when utilized as a protective sheet according to Embodiment 1 of the present invention. When the upper cover 11 is utilized as a protective sheet for keeping out dust etc., an incision is made with a knife etc. into the cut and bent up part 11*a* to cut and bend it up nearly at a right angle. The slit part 11*b* is formed in the cut and bent up part 11*a*, and the hanging clamp 5 of the unit main body 2 is inserted into this slit part 11*b*. Here, the cut and bent up part 11*a* is formed so that the insertion direction of the hanging clamp 5 and the bent-up surface intersect orthogonally with each other. In order to secure the length of the slit part 11*b* without making an incision at the edge of the upper cover 11, part of the sides of the cut and bent up part 11*a* is inclined. When utilized as a protective sheet, the cover part 11*c* covers the opening part of the unit main body 2 to keep out dust etc., and the cover part 11*c* corresponds to the area surrounded by the cut and bent up parts 11*a*.

The upper cover 11 can be fixed on the unit main body 2 and the opening part of the unit main body 2 can be covered with the cover part 11*c* by inserting the hanging clamps 5 into the slit parts 11*b*. Here, a member having the slit part 11*b* for inserting the hanging clamp 5 (an insert member corresponding to the cut and bent up part 11*a*) may be formed previously so as to be nearly at a right angle to the upper cover 11. However, this can be inconvenient, for example, in that the packing materials cannot be stacked up for transport. While the upper cover 11 may come with an incision, slit, etc. made in it to serve as the cut and bent up part 11*a* and the slit part 11*b*, dust etc. can enter inside the unit main body during transport. Therefore, in this embodiment, the cut and bent up part 11*a* and the slit part 11*b* are only printed, and an incision etc. is made to cut and bend up the cut and bent up part 11 before use.

Figure 4:
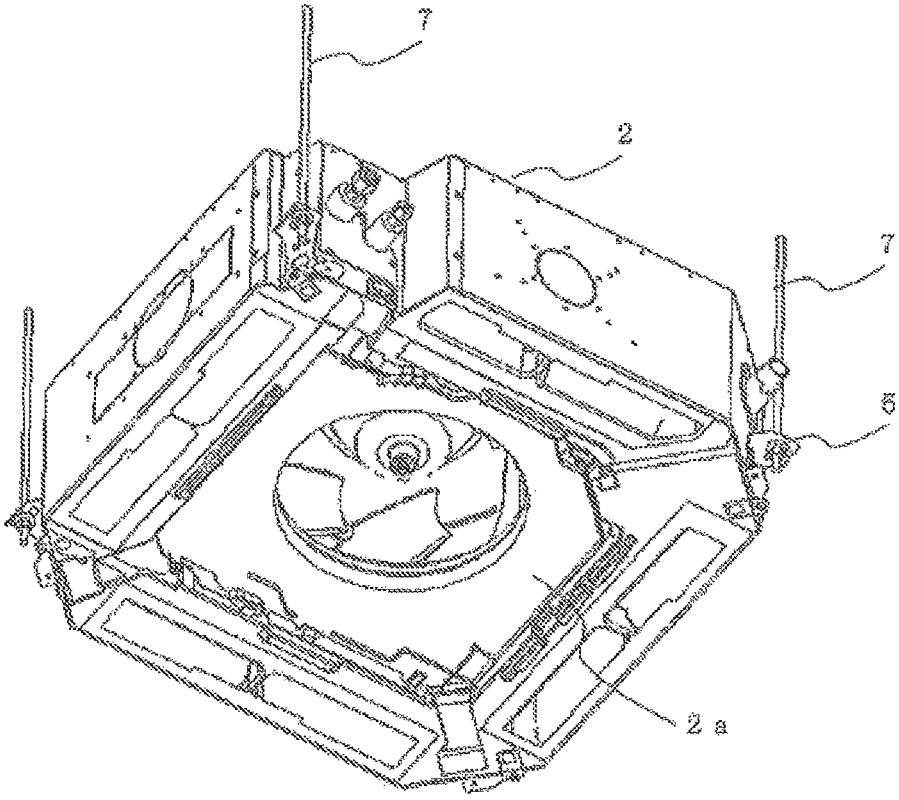
FIG. 4 is a view showing the installation state of the air conditioner according to Embodiment 1 before a decorative panel 3 is mounted.

FIG. 4 is a view showing the installation state of the air conditioner according to Embodiment 1 of the present invention before the decorative panel 3 is mounted. As described above, the unit main body 2 has an opening part 2*a* directed toward the indoor space. In the case where interior work of a building etc. is performed, the decorative panel 3 is mounted after ceiling installation. Before ceiling installation, piping work is performed for an air conditioner. In addition, wiring work etc. of electric equipment such as lighting fixtures is performed. Therefore, dust etc. deposits in an interior passage if the opening part 2*a* of the unit main body 2 is left exposed to the external space.

Figure 5A:
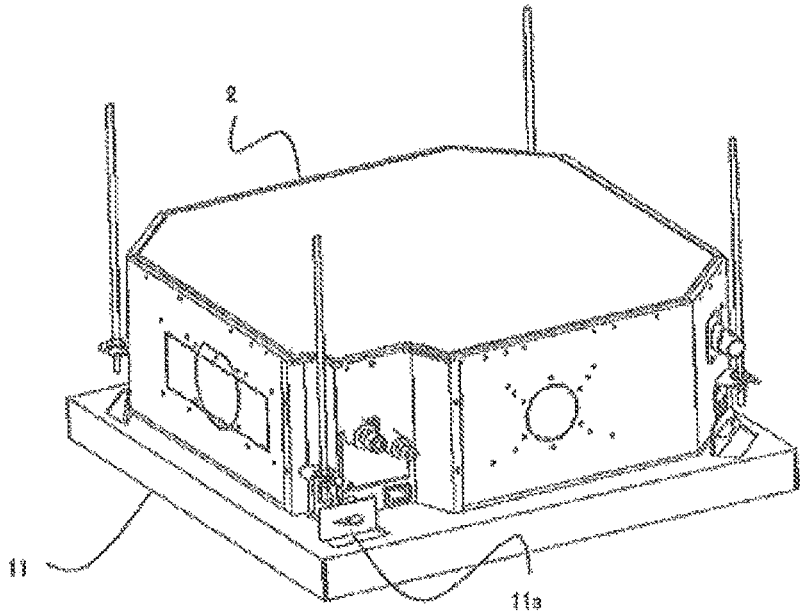
FIG. 5A is a view illustrating the form of use when the upper cover 11 according to Embodiment 1 of the present invention is used as a protective sheet, and is an overall view when the upper cover 11 is mounted on the unit main body 2.
Figure 5B:
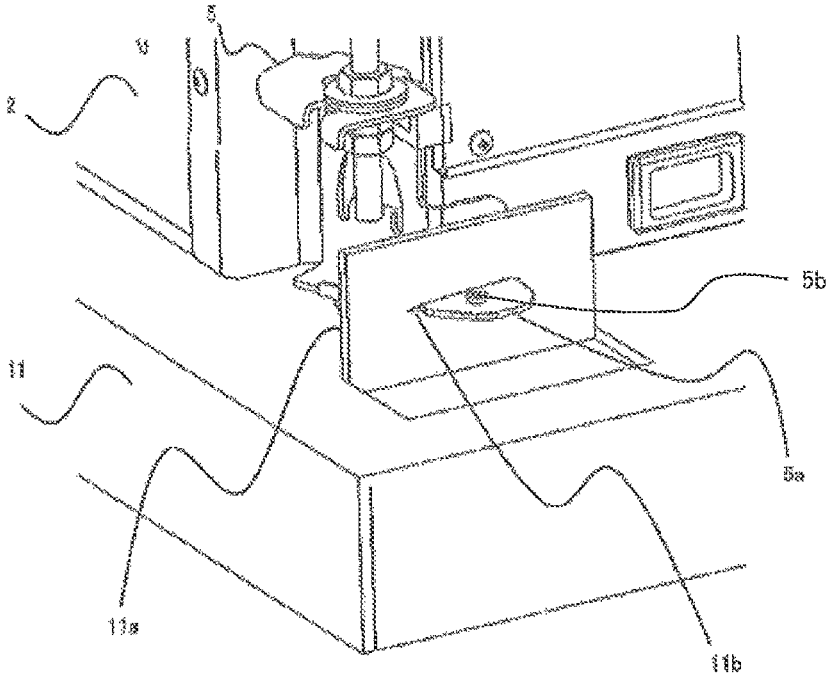
FIG. 5B is a view illustrating the form of use when the upper cover 11 according to Embodiment 1 of the present invention is used as a protective sheet, and is an enlarged view of the slit part 11*b* when a protruding portion 5*a* of the hanging clamp 5 is inserted into the slit part 11*b* and the unit main body 2 and the upper cover 11 are fixed with each other.

FIGS. 5A and 5B are views illustrating the form of use when the upper cover 11 according to Embodiment 1 of the present invention is used as a protective sheet. FIG. 5A is an overall view when the upper cover 11 is mounted on the unit main body 2. FIG. 5B is an enlarged view of the slit part 11*b* when a protruding portion 5*a* of the hanging clamp 5 is inserted into the slit part 11*b* and the unit main body 2 and the upper cover 11 are fixed with each other. The unit main body 2 and the upper cover 11 can be fixed with each other by inserting the protruding portion 5*a* of the hanging clamp 5 into the slit part 11*b*. Here, it is possible to prevent the hanging clamp 5 from coming out of the slit part 11*b* and fix the hanging clamp 5 more firmly, for example, by forming a projection 5*b* in the protruding portion 5*a*, inserting the hanging clamp 5 so that the slit part 11*b* is located further on the inside than the projection 5*b*, and engaging the slit part 11*b* with the projection 5*b*.

As has been described, in the packing material for an air conditioner of Embodiment 1, since the upper cover 11 is utilized as a protective sheet for covering the opening part of the unit main body 2, it is not necessary to use a curing sheet to keep dust etc. out of the unit main body 2, for example, during the period after installation of the unit main body 2 up to mounting of the decorative panel 3. Since the packing material is fixed by inserting the hanging clamp 5 of the unit main body 2 into the slit part 11*b* of the cut and bent up part 11*a* of the upper cover 11, engaging with bolts or fixing with tape is not required. Thus, the trouble is saved and waste reduction can be realized. In addition, the upper cover 11 can be used as a paper pattern for positioning the air conditioner in the ceiling. Moreover, deposition of dust etc. can be more efficiently prevented if an antistatic ink (paint) is used for printing on the upper cover 11.

Embodiment 2

In Embodiment 1 described above, the hanging clamps 5 of the unit main body 2 are inserted into the slit parts 11*b*. However, the present invention is not limited to this example, and other metal fittings, etc. protruding from the unit main body 2 may be inserted into the slit parts 11*b*. As long as the unit main body 2 can be fixed with its opening part covered, any form of fixation may be adopted, for example, engaging the slit part 11*b* with a decorative panel fixing bracket for fixing the decorative panel 3 on the unit main body 2. Alternatively, an engaging member for fixing the packing material may be newly provided.

In Embodiment 1 described above, the upper cover 11 is mounted so that the upper surface side of the upper cover 11 and the opening part of the unit main body 2 face each other. However, the upper cover 11 may be mounted so that the lower surface side of the upper cover 11 and the opening part of the unit main body 2 face each other.

In Embodiment 1 described above, the upper cover 11 is used as a protective sheet, but the body part cover 12 etc. may be used instead as a protective sheet.

Reference Signs List

| | | |
|---|---|---|
| 1 indoor unit | 2 unit main body | 2a opening part |
| 3 decorative panel | 4 airflow directing vane | 5 hanging clamp |
| 5a protruding portion | 7 hanging bolt | 11 upper cover |
| 11a cut and bent up part | 11b slit part | 11c cover part |
| 12 body part cover | 13 lower cover | |

The invention claimed is:

1. A packing system, comprising:

an air conditioner that includes a main body to be installed in a ceiling, the main body includes an opening that exposes components inside the main body and a protruding portion; and an air conditioner packaging that includes an upper cover that covers the opening of the main body, and a body cover that surrounds sides of the main body and attaches to the upper cover, wherein the upper cover covers the opening of the main body through which components inside the main body are exposed, the upper cover includes:

a first face and a second face opposite to the first face, the first face of the upper cover includes a printed alignment border shaped to match a lower surface of the air conditioner; and a cut and bent up part having a slit part that mates with the protruding portion included in the main body of the air conditioner and configured to fix the upper cover to the main body.

2. The packing system of claim 1, wherein the air conditioner packaging has the cut and bent up part at such a position that the protruding portion located on the main body at an outside of the opening can be inserted into the slit part.

3. The packing system of claim 1, wherein a hanging clamp having a hole, through which a hanging bolt suspended from a ceiling is passed, is inserted as the protruding portion into the slit part.

4. A packing system, comprising:

an air conditioner that includes a main body to be installed in a ceiling, the main body includes an opening that exposes components inside the main body and a protruding portion; and an air conditioner packaging that includes:

an upper cover that covers the opening of the main body through which components inside the main body are exposed, a body cover that surrounds sides of the main body and attaches to the upper cover, a cut and bent up part having a slit part that mates with the protruding portion included in the main body of the air conditioner and configured to fix the upper cover to the main body, wherein a printed portion serving as the cut and bent up part is printed on a portion of the air conditioner packaging that is made of cardboard, and the cut and bent up part is formed by making an incision along the printed portion.

5. The packing system of claim 4, wherein the printed portion is printed with antistatic ink.

6. The packing system of claim 1, wherein the cut and bent up part is formed by bending a part of the upper cover.

7. The packing system of claim 1, wherein the upper cover is detachable from the body cover.

8. The packing system of claim 1, wherein the protruding portion included in the main body is inserted into the slit part of the cut and bent up part of the upper cover.

9. The packing system of claim 4, wherein the protruding portion included in the main body is inserted into the slit part of the cut and bent up part of the upper cover.

* * * * *